US009623664B2

(12) United States Patent
Maeshima

(10) Patent No.: US 9,623,664 B2
(45) Date of Patent: Apr. 18, 2017

(54) LIQUID STORAGE AND INK CONTAINER AND INKJET IMAGE FORMING APPARATUS INCLUDING THIS

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/034,096

(22) PCT Filed: Oct. 29, 2014

(86) PCT No.: PCT/JP2014/078704
§ 371 (c)(1),
(2) Date: May 3, 2016

(87) PCT Pub. No.: WO2015/079855
PCT Pub. Date: Jun. 4, 2015

(65) Prior Publication Data

US 2016/0263903 A1 Sep. 15, 2016

(30) Foreign Application Priority Data

Nov. 29, 2013 (JP) ..... 2013-246958

(51) Int. Cl.
*B41J 2/175* (2006.01)
*B41J 29/13* (2006.01)

(52) U.S. Cl.
CPC ..... *B41J 2/17503* (2013.01); *B41J 2/175* (2013.01); *B41J 2/17513* (2013.01); (Continued)

(58) Field of Classification Search
CPC B41J 2/17503; B41J 2/17513; B41J 2/17523; B41J 2/175; B41J 2002/17516
See application file for complete search history.

(56) References Cited

U.S. PATENT DOCUMENTS 5,883,653 A 3/1999 Sasaki
2005/0185036 A1* 8/2005 Seino ..... B41J 2/1752 347/86

FOREIGN PATENT DOCUMENTS

JP H06-238908 A 8/1994
JP H09-024624 A 1/1997
(Continued)

OTHER PUBLICATIONS

International Search Report of PCT/JP2014/078704 mailed Feb. 3, 2015.
Written Opinion of PCT/JP2014/078704 mailed Feb. 3, 2015.

*Primary Examiner* — Geoffrey Mruk
(74) *Attorney, Agent, or Firm* — Studebaker & Brackett PC

(57) ABSTRACT

A liquid storage (52) of the present invention includes a liquid storing part (55) storing liquid and a spout (56) having a flow path (56*a*) opened/closed according to relative attaching and detaching of a connected subject (33) being a flow destination of the liquid stored in the liquid storing part (55), and the spout (56) includes a contact face (75) having an opening part (72*a*) opened so as to lead to the flow path (56*a*), with which the connected subject (33) comes into contact when attaching the connected subject (33), and a liquid groove (76) recessed in the contact face (75) to guide and hold the liquid adhered onto the opening part (72*a*) when detaching the connected subject (33).

11 Claims, 14 Drawing Sheets

(52) U.S. Cl.
CPC ..... *B41J 2/17523* (2013.01); *B41J 29/13* (2013.01); *B41J 2002/17516* (2013.01)

(56) References Cited

FOREIGN PATENT DOCUMENTS

| | | | |
|---|---|---|---|
| JP | H09-029993 | A | 2/1997 |
| JP | 2001-071528 | A | 3/2001 |

* cited by examiner

LIQUID STORAGE AND INK CONTAINER AND INKJET IMAGE FORMING APPARATUS INCLUDING THIS

TECHNICAL FIELD

The present disclosure relates to a liquid storage storing a liquid, such as an ink, and an ink container and an inkjet image forming apparatus including this.

BACKGROUND ART

An inkjet image forming apparatus forming an image on a sheet by ejecting an ink supplied via a supplying port of a liquid storage as an ink drop from a recording head is widely known.

For example, in Patent Document 1, an ink cartridge, in which a liquid chamber storing an ink of a liquid is formed and an ink supplying port bored in a wall face of the liquid chamber is sealed by an elastic sealing material, is disclosed. This ink cartridge is slid on a carriage stand and connected to a printing head as a connected subject. At this time, a hollow needle arranged at a side of the printing head pierces the elastic sealing material of the ink supplying port of the ink cartridge to be inserted into the liquid chamber.

PRIOR ART DOCUMENT

Patent Document

[PATENT DOCUMENT 1] Japanese patent laid-open publication No. H06-238908

SUMMARY OF INVENTION

Problems to be Solved by the Invention

However, the above-mentioned ink cartridge may make the ink adhered on an outside face of the elastic sealing material when the hollow needle is relatively pulled out. That is, at the moment when the hollow needle is completely pulled out, the ink slightly leaked is adhered on the outside face of the elastic sealing material. This ink adhered on the elastic sealing material is feared to drip by gravity and to soil the carriage stand and the inside of the apparatus.

The present invention is provided to solve the above-mentioned problems and its object is to provide a liquid storage restraining a drip of a liquid leaked when a connected subject is detached, and an ink container and an inkjet image forming apparatus including this.

Means for Solving the Problem

A liquid storage of the present invention includes a liquid storing part storing liquid and a spout having a flow path opened/closed according to relative attaching and detaching of a connected subject being a flow destination of the liquid stored in the liquid storing part, and the spout includes a contact face having an opening part opened so as to lead to the flow path, with which the connected subject comes into contact when attaching the connected subject, and a liquid groove recessed in the contact face to guide and hold the liquid adhered onto the opening part when detaching the connected subject.

An ink container of the present invention includes the above-mentioned liquid storage.

An inkjet image forming apparatus of the present invention includes the above-mentioned ink container.

Effects of the Invention

In accordance with the present invention, it is possible to restrain a drip of a liquid leaked when a connected subject is detached.

MODES FOR CARRYING OUT THE INVENTION

In the following, an embodiment of the present invention will be described with reference to the appended drawings. Incidentally, in the following description, for convenience, an arrow Fr indicated in each figure and this side of a paper face in FIG. 2 are defined as a front face side (a front side) of a color printer.

First Embodiment

Figure 1:
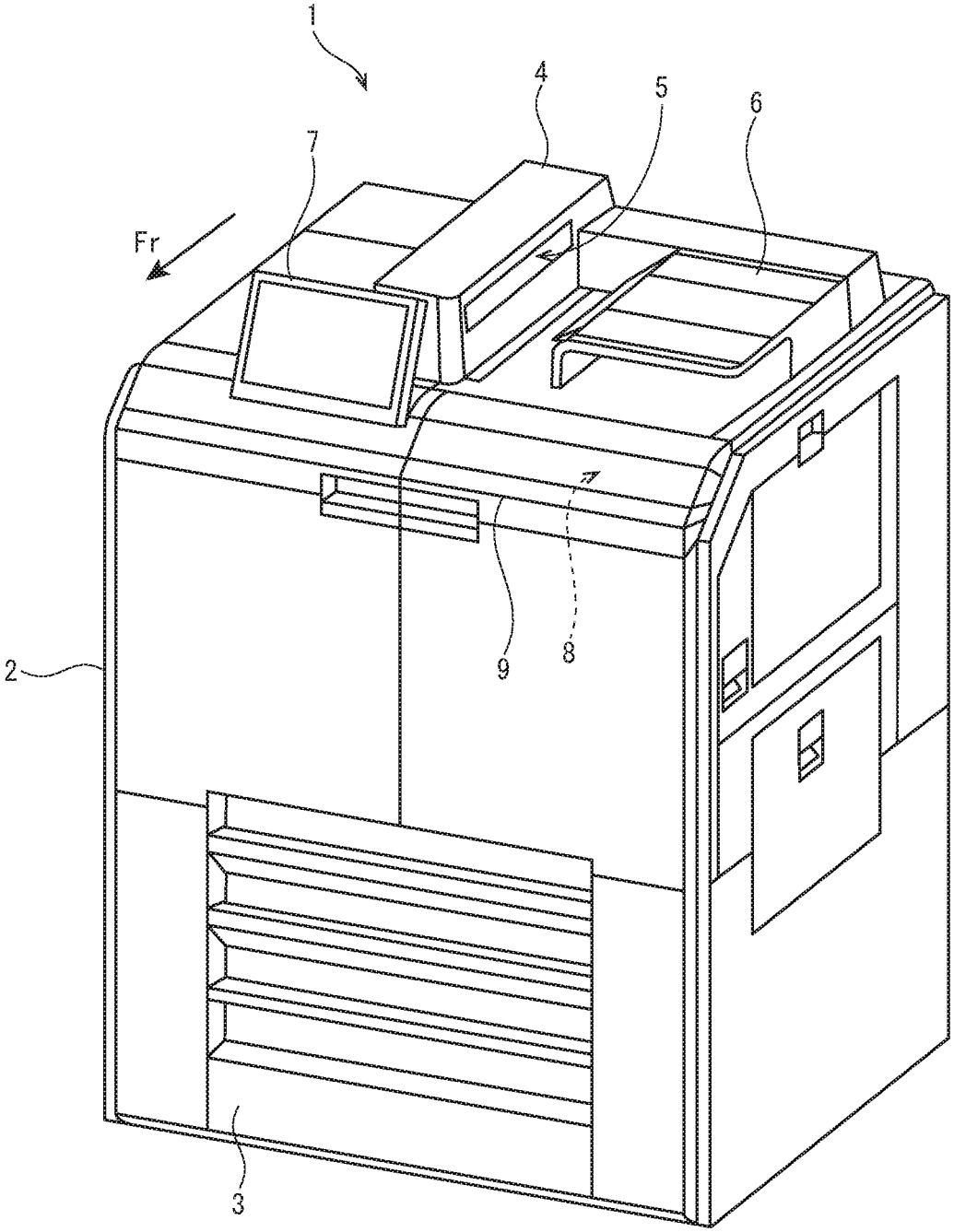
FIG. 1 It is a perspective view showing a printer in accordance with a first embodiment of the present invention.
Figure 2:
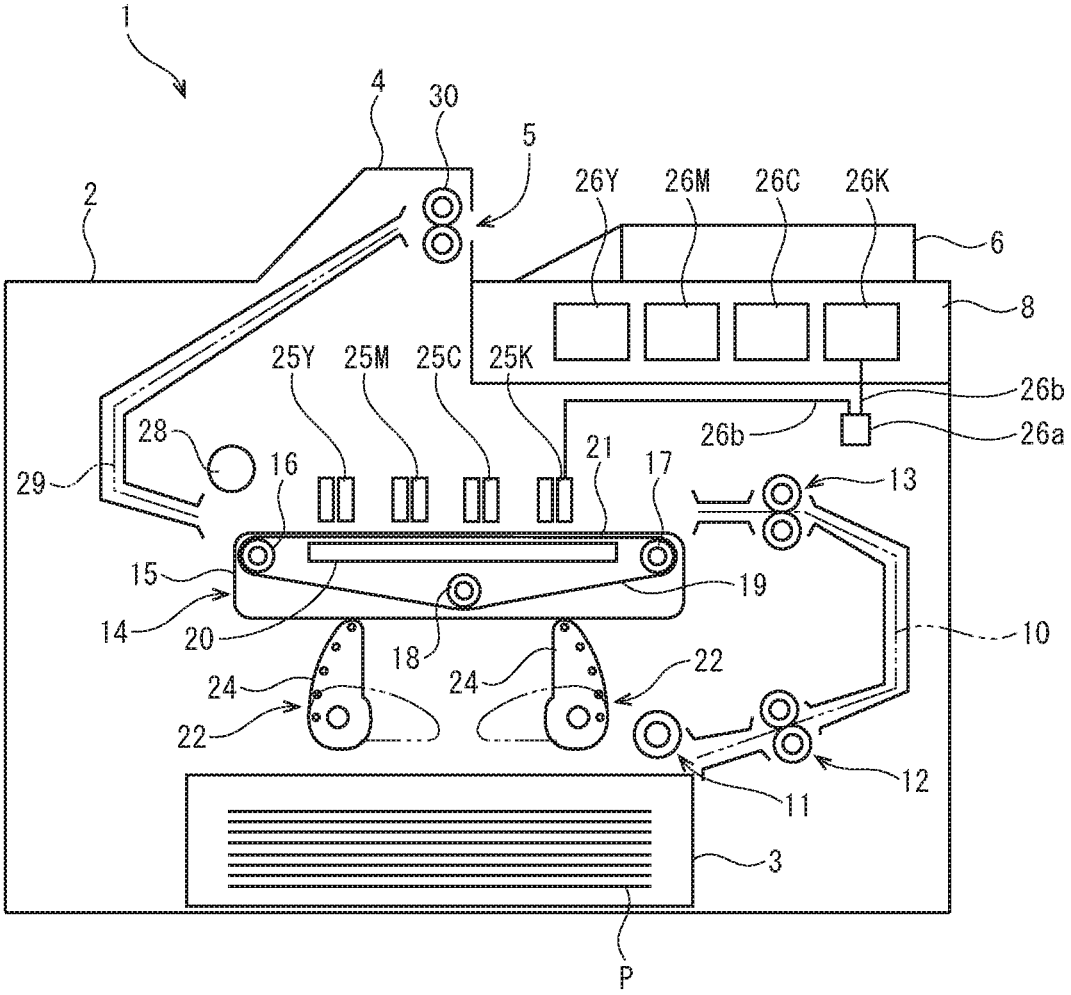
FIG. 2 It is a sectional view schematically showing an internal structure of the printer in accordance with the first embodiment of the present invention.
Figure 3:
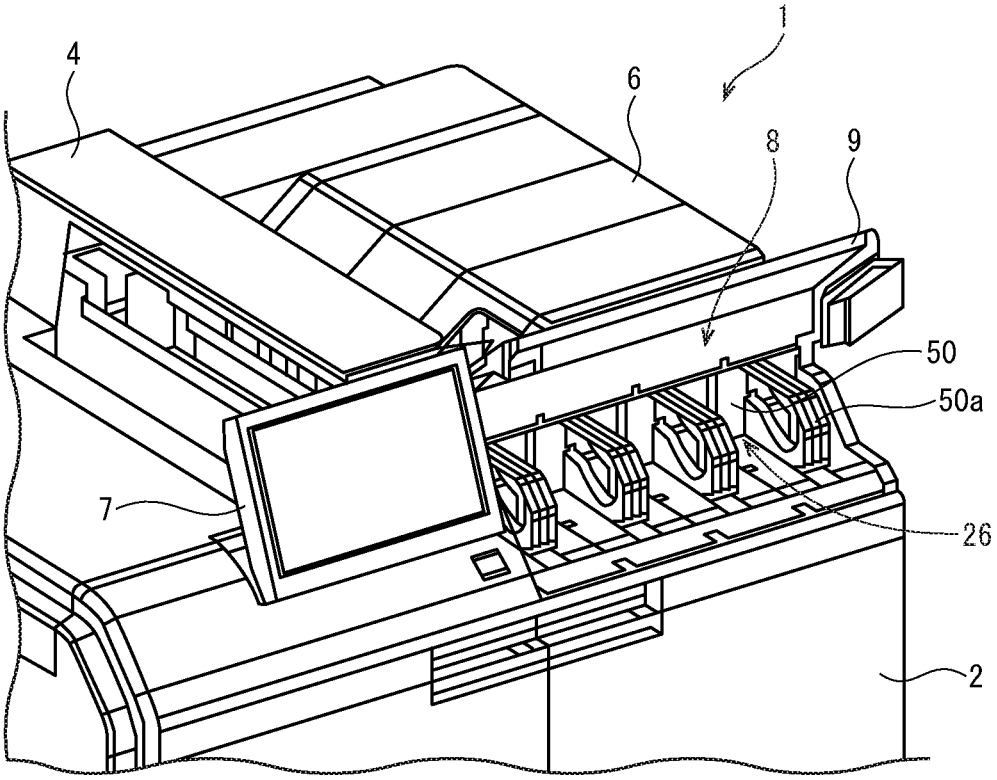
FIG. 3 It is a perspective view showing the printer in a state, where an installation cover of a container installed part is opened, in accordance with the first embodiment of the present invention.

With reference to FIGS. 1 to 3, an entire structure of an inkjet color printer 1 (often called as a "printer 1") according to a first embodiment will be described. FIG. 1 is a perspective view showing a printer 1 and FIG. 2 is a sectional view schematically showing an internal structure of the printer 1. FIG. 3 is a perspective view showing a state where an installation cover 9 of a container installed part 8 of the printer 1 is opened.

As shown in FIGS. 1 and 2, the printer 1 includes a box-formed printer main body 2. In a lower part of the printer main body 2, a plurality of sheet feeding cassette 3 storing a sheet P is installed pullably. Incidentally, for the sake of convenience of the description, in FIG. 2, only one of the plurality of sheet feeding cassette 3 is illustrated.

In a top face of the printer main body 2, a protruding part 4 is formed and, in its right face, an ejecting port 5 ejecting the sheet P after image forming to an ejected sheet tray 6 is opened. At a forward side of the protrusion 4, a touch panel-type operational panel 7 is attached. In a right upper part of the printer main body 2, a container installed part 8 including an openable/closable installation cover 9 is arranged (refer to FIG. 3).

As shown in FIG. 2, in a right part of the printer main body 2, a conveying path 10 for the sheet P extending upwardly from the vicinity of the sheet feeding cassette 3 is arranged. At an upstream end part of the conveying path 10, a sheet feeding roller 11 is positioned and, at a right side of the sheet feeding roller 11, a pair of conveying rollers 12 are positioned. At a downstream end part of the conveying path 10, a pair of registration rollers 13 are positioned.

In an intermediate part of the printer main body 2, a conveying unit 14 supported by an upward/downward movable conveyance frame 15 is arranged. The conveying unit 14 includes a driving roller 16, a following roller 17 and a tension roller 18 rotatably supported by the conveyance frame 15, and an endless conveyance belt 19 wound around each roller 16, 17, 18, and an air intake duct 20 located so as to be surrounded by the conveyance belt 19.

In an upper face of the conveyance belt 19, a roughly flat conveyance face 21 is formed. In upper faces of the conveyance belt 19 and the air intake duct 20, a lot of air intake holes (not shown) are formed. By activating a sucking means (not shown), such as a suction pomp, connected to the air intake duct 20, suction force is acted on the conveyance face 21 via the lot of air intake holes.

At a downward side of the conveying unit 14, a pair of left and right elevating means 22 are arranged. Each elevating means 22 drives a motor (not shown) to rotate each cam 24 between an upright posture (refer to solid line in FIG. 2) and a laid-down posture (refer to two-dot chain line in FIG. 2). Each cam 24 lifts up the conveyance frame 15 to move the conveying unit 14 upwardly by taking the upright posture and releases lifting of the conveyance frame 15 to move the conveying unit 14 downwardly by taking the laid-down posture.

At an upward side of the conveying unit 14, four recording heads 25 (25K, 25C, 25M, 25Y) corresponding to the respective colors of black (K), cyan (C), magenta (M) and yellow (Y) are arranged in parallel in order from an upstream side in a conveying direction of the sheet P. The recording head 25 of each color has nozzles (not shown) facing to the conveyance face 21 of the conveyance belt 19.

As shown in FIGS. 2 and 3, in the container installed part 8, four ink containers 26 (26K, 26C, 26M, 26Y) for the respective colors of inks (liquids) are installed in parallel attachably/detachably in forward and backward directions. The four ink containers 26 contains the respective inks of black (K), cyan (C), magenta (M) and yellow (Y) in order from the upstream side in the conveying direction of the sheet P. Incidentally, except for a case of describing with specifying the color, about the recording head 25 and the ink container 26, reference numeral of only Arabic numerals is put.

As shown in FIG. 2, each ink container 26 is connected to each recording head 25 via a sub container 26*a* by ink supplying tubes 26*b*. The ink stored in each ink container 26 is temporarily stored in the sub container 26*a*, and then, supplied to each recording head 25. Incidentally, the sub container 26*a* and the ink supplying tubes 26*b* are arranged so as to correspond to the ink of each color, but FIG. 2 illustrates only one corresponding to black (K).

In a left upper part of the printer main body 2, a drying device 28, an ejecting path 29 and a pair of ejecting rollers 30 are arranged. The ejecting path 29 extends to a left side of the drying device 28, goes upwardly with a roughly U-turn and extends to the pair of ejecting rollers 30 near the ejecting port 5. Incidentally, the drying device 28 may be omitted.

Next, the operation of forming an image by the printer 1 having a configuration mentioned above will be described.

The printer 1, when receiving image data from an external computer (not shown) or the like, drives and rotates the sheet feeding roller 11 to pick up the sheet P in the sheet feeding cassette 3, and drives and rotates the conveying rollers 12 to feed the picked-up sheet P to the conveying path 10. The printer 1 drives and rotates the pair of registration rollers 13 to feed the sheet P from the conveying path 10 to the conveyance face 21 of the conveyance belt 19. The printer 1 drives the sucking means connected to the air intake duct 20 to suck the sheet P onto the conveyance face 21.

The printer 1 ejects the ink supplied from each ink container 26 out of the nozzles of each recording head 25 on the basis of the image data. Thereby, an ink image is formed on the sheet P sucked on the conveyance face 21. After that, the printer 1 drives and rotates the driving roller 16 to feed the sheet P, in which the image is formed, to the ejecting path 29, and drives and rotates the pair of ejecting rollers 30 to eject the sheet P from the ejecting port 5 onto the ejected sheet tray 6. Incidentally, the printer 1 drives the drying device 28 to dry the ink on the sheets in the middle in a way from the conveyance face 21 to the ejecting path 29.

Figure 4:
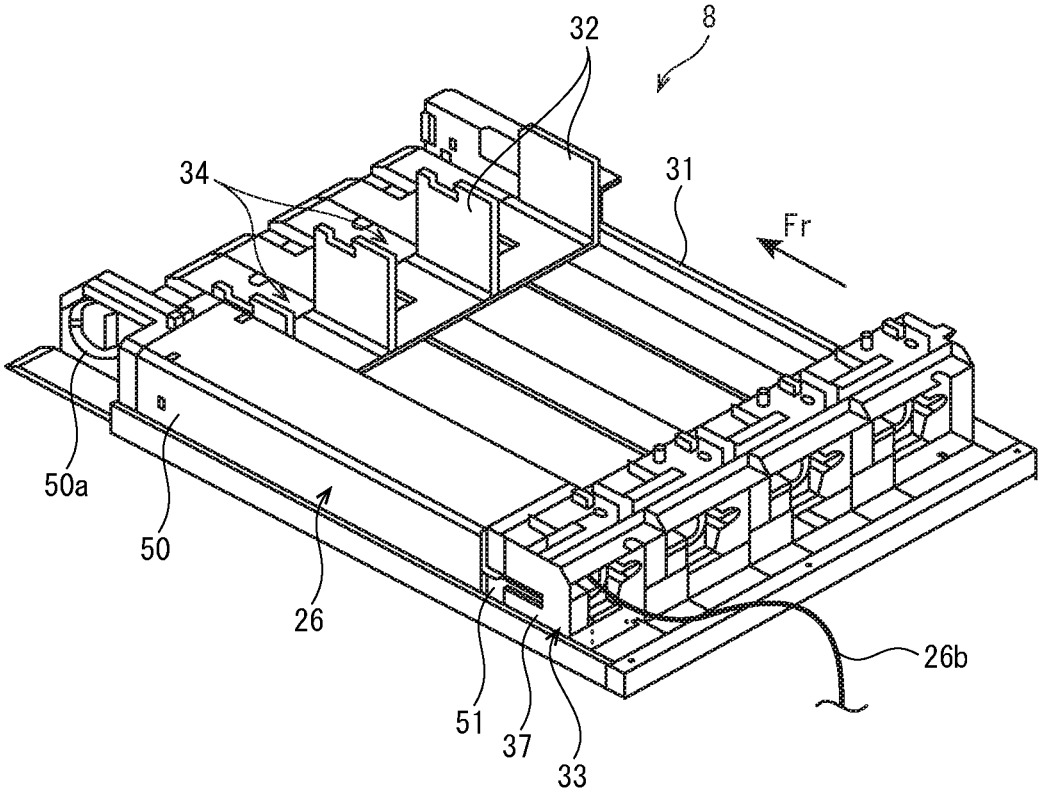
FIG. 4 It is a perspective view showing the container installed part of the printer in accordance with the first embodiment of the present invention.
Figure 5:
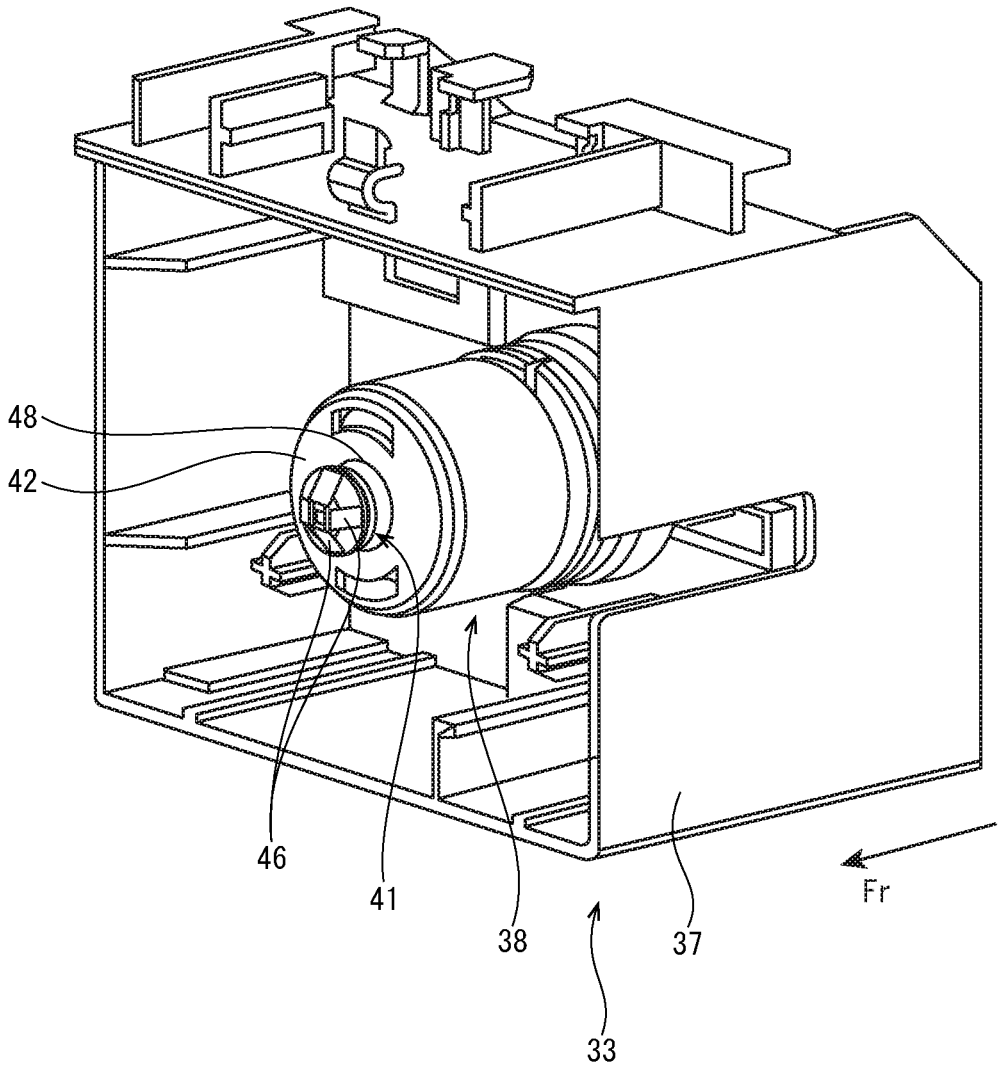
FIG. 5 It is a perspective view showing a connecting mechanism part of the container installed part of the printer in accordance with the first embodiment of the present invention.
Figure 6:
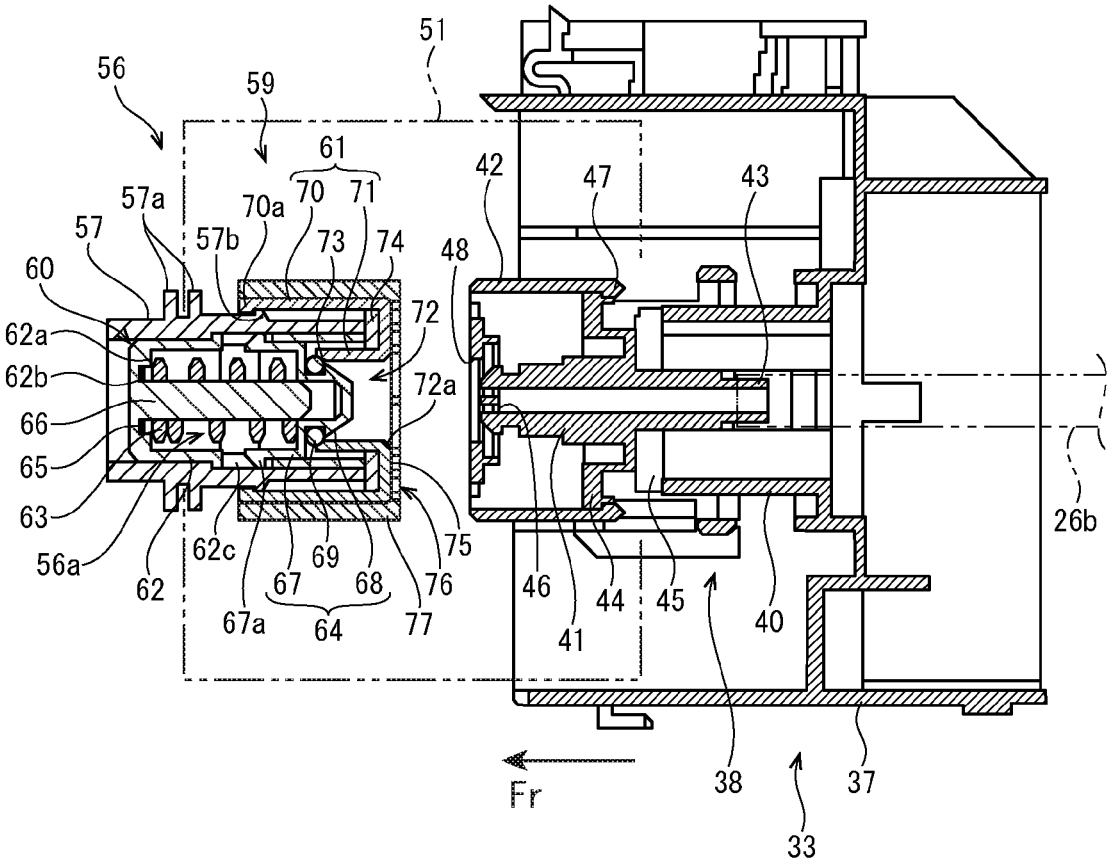
FIG. 6 It is a lateral sectional view showing the printer in a state, where the connecting mechanism part and a spout of a pouch pack are not connected, in accordance with the first embodiment of the present invention.
Figure 7:
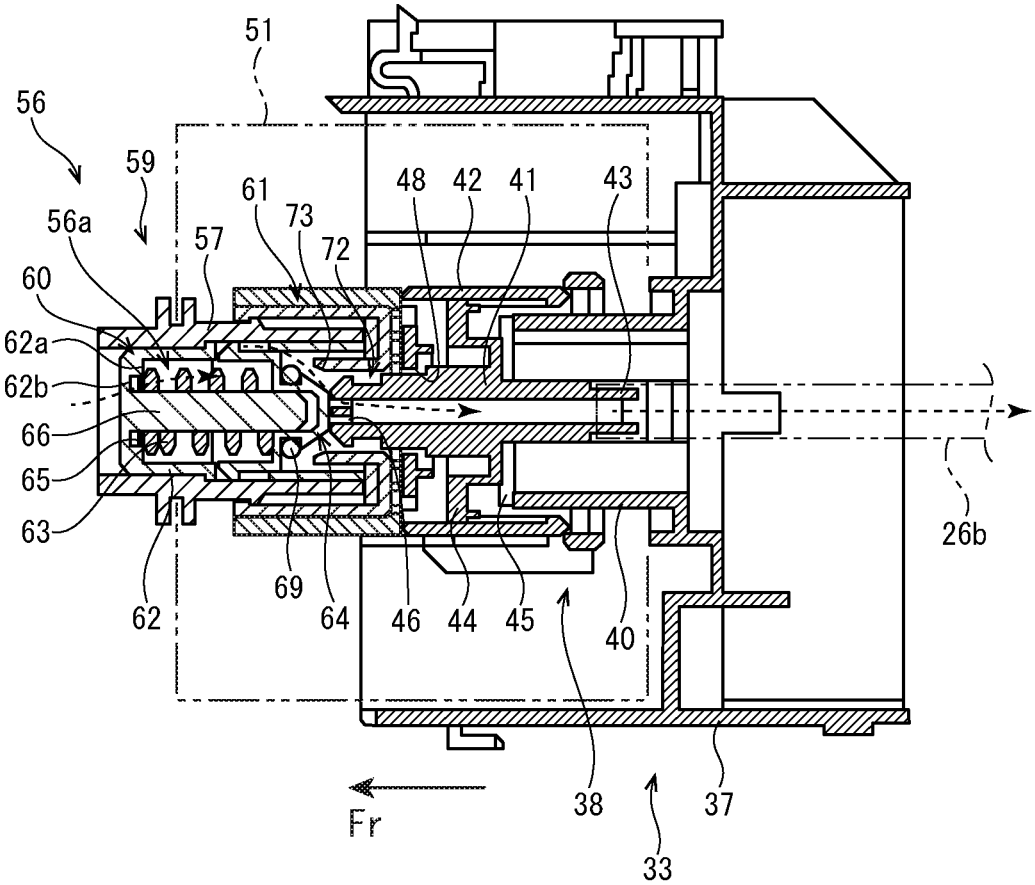
FIG. 7 It is a lateral sectional view showing the printer in a state, where the connecting mechanism part and a spout of the pouch pack are connected, in accordance with the first embodiment of the present invention.

Next, with reference to FIGS. 3 to 7, the container installed part 8 will be described. FIG. 4 is a perspective view showing the container installed part 8. FIG. 5 is a perspective view showing a connecting mechanism part 33 of the container installed part 8. FIGS. 6 and 7 are lateral sectional views showing the connecting mechanism part 33 and a spout 56 of a pouch pack 52, wherein FIG. 6 shows a not-connected state and FIG. 7 shows a connected state.

As shown in FIG. 4, the container installed part 8 includes a flat plate formed installed frame 31, four partition plates 32 arranged in parallel in left and right directions at a forward side of the installed frame 31 and four connecting mechanism parts 33 arranged in parallel adjacently in left and right directions in a rear end part of the installed frame 31.

Each partition plate 32 is formed in a plate shape elongated in the forward and backward directions and is erected at regular intervals from a left end of the installed frame 31 to the right direction. Into four installed spaces 34 arranged by being partitioned by the respective partition plates 32, the ink containers 26 are respectively inserted in the forward and backward directions.

As shown in FIG. 5, each connecting mechanism part 33 as a connected subject has a connecting frame 37 formed in a rectangular cylindrical shape opened in the forward and backward directions and a connecting main body 38 arranged at a backward side from the center in the forward and backward directions inside the connecting frame 37. Incidentally, since four connecting mechanism parts 33 have the similar structures to each other, one connecting mechanism part 33 will be spotted and described as follows.

The connecting main body 38 has a guide tube part 40 (refer to FIG. 6) formed integrally with the connecting frame 37, a needle 41 supported in a shaft center of the guide tube part 40 so as to be capable of advancing and retreating in the forward and backward directions and a connecting part 42 supported so as to be capable of advancing and retreating with respect to the needle 41.

As shown in FIGS. 6 and 7, the guide tube part 40 is formed in a hollow cylindrical shape projected forwardly and is arranged at the center of an inside face of the connecting frame 37.

The needle 41 is formed in a roughly hollow cylindrical shape and has a flange part 44 projected from a roughly center in the forward and backward directions to an outside in a radial direction. The needle 41 inserts its rear side from the flange part 44 into the inside of the guide tube part 40. In a rear end part of the needle 41, a tube connected part 43, to which am upstream side end part of the ink supplying tube 26*b* is connected, is protruded. Moreover, between the flange part 44 and the guide tube part 40, a biasing member 45 (e.g. a spring or a rubber) biasing the needle 41 forwardly is arranged. Further, in a front end part of the needle 41, four flow opening parts 46 are formed in regular intervals in a circumferential direction.

The connecting part 42 is formed in a roughly cylindrical shape with opening its rear side. In a rear end part of the connecting part 42, a claw part 47 engaging with the flange part 44 is formed and, at a shaft center of a front end face of the connecting part 42, a circular hole 48, into which a distal end part of the needle 41 is inserted, is formed. The connecting part 42 is supported slidably in the forward and backward direction by engaging the claw part 47 with the flange part 44. Incidentally, the connecting part 42 is biased forwardly by a biasing member, which illustration is omitted.

Figure 8:
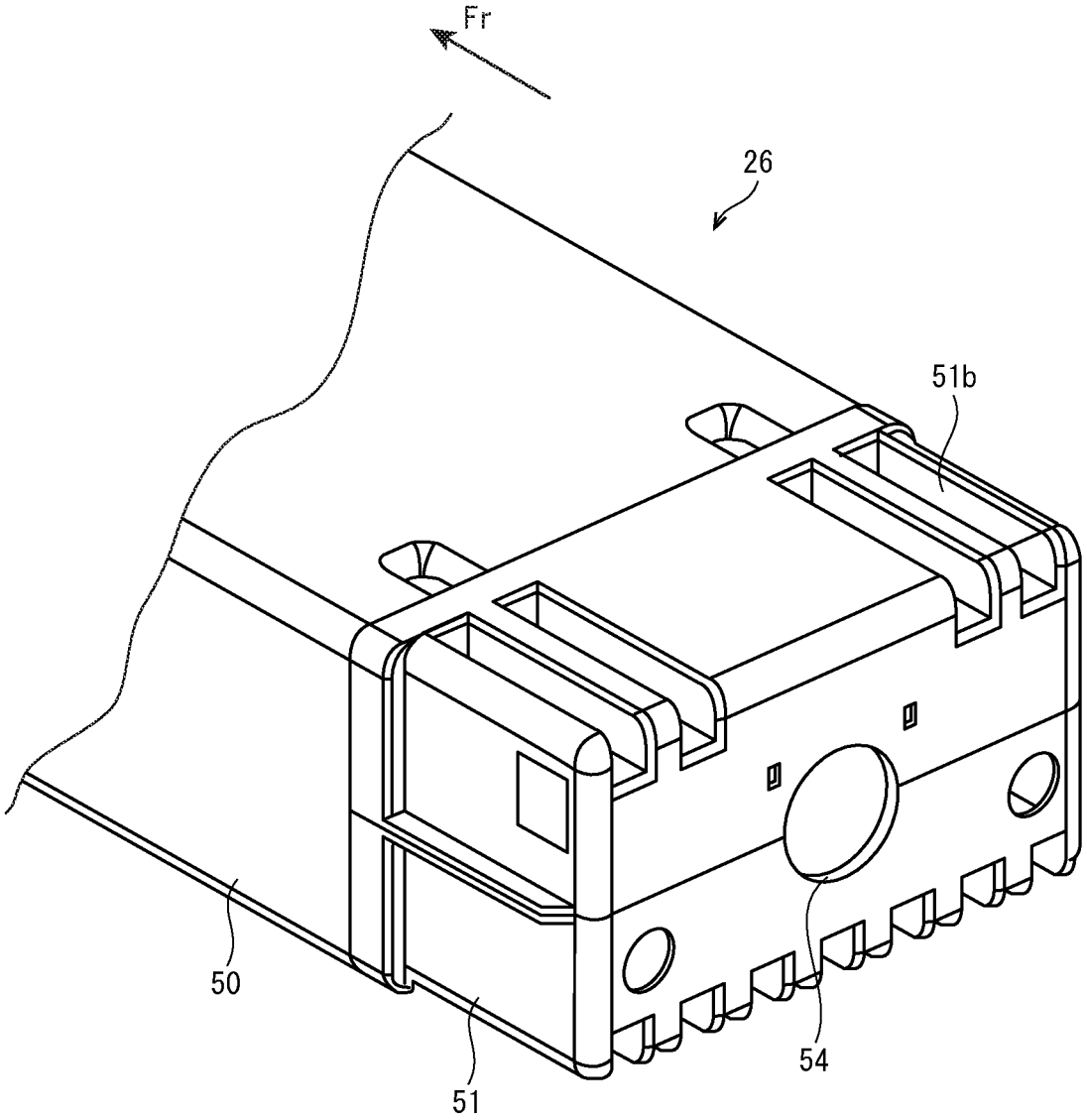
FIG. 8 It is a perspective view showing a part of an ink container of the printer in accordance with the first embodiment of the present invention.
Figure 9:
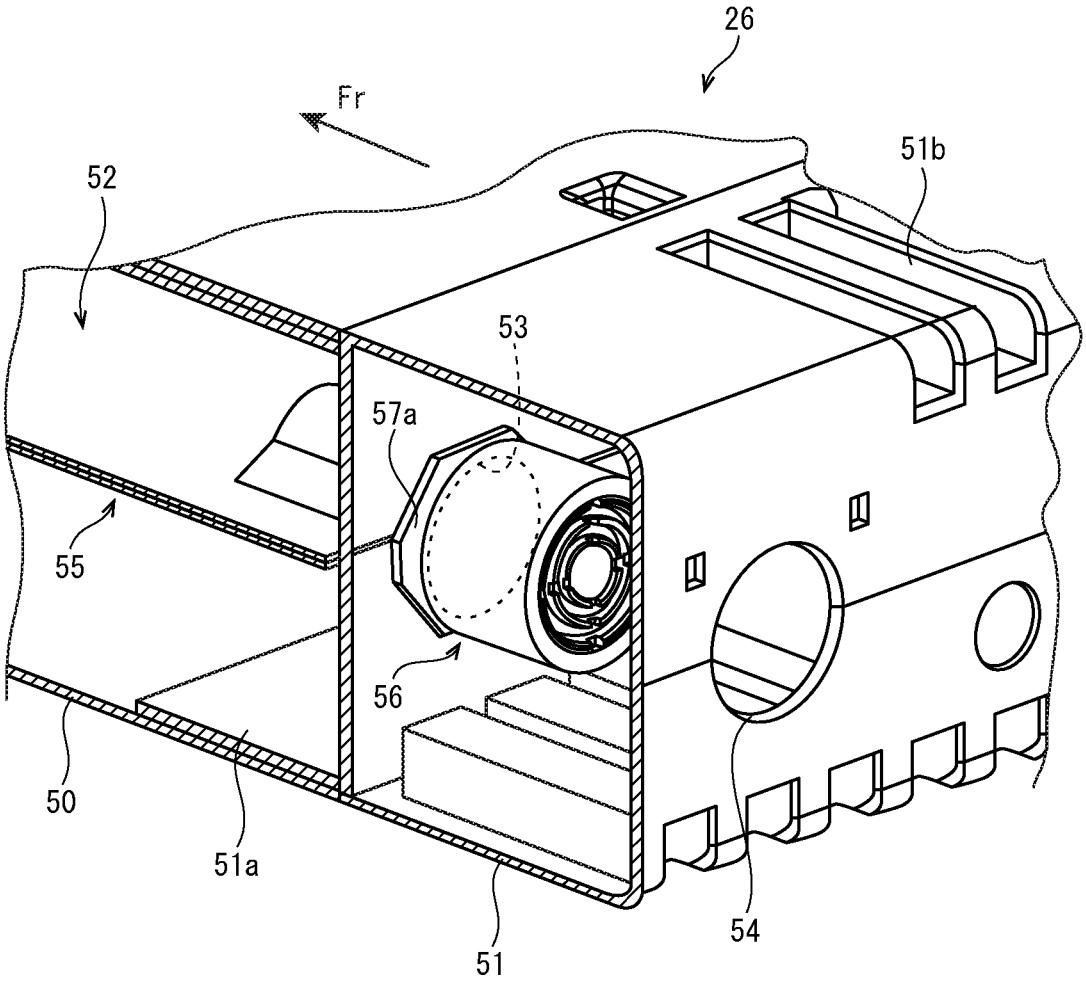
FIG. 9 It is a sectional perspective view showing a part of the ink container of the printer in accordance with the first embodiment of the present invention.
Figure 10:
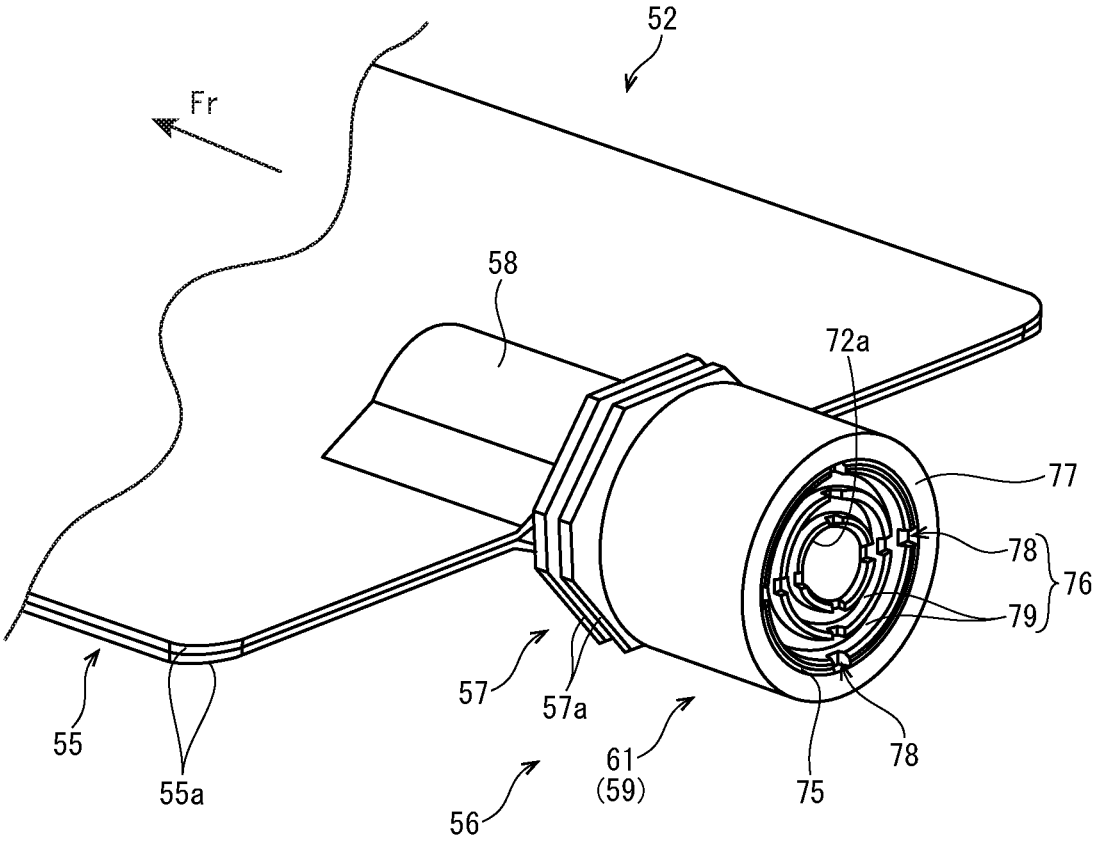
FIG. 10 It is a perspective view showing a part of the pouch pack in accordance with the first embodiment of the present invention.

Next, with reference to FIGS. 4 and 6 to 10, the ink container 26 will be described. FIG. 8 is a perspective view showing a part of the ink container 26. FIG. 9 is a sectional perspective view showing a part of the ink container 26. FIG. 10 is a perspective view showing a part of the pouch pack 52. Incidentally, since four ink containers 26 have the similar structures to each other, one ink container 26 will be spotted and described as follows.

As shown in FIG. 4, the ink container 26 includes a container case 50 formed in a roughly rectangular parallelepiped shape elongated in the forward and backward directions, a spout cover 51 installed to a rear part of the container case 50 and the pouch pack 52 (refer to FIG. 9) installed inside the container case 50.

The container case 50 is a hollow case having a capacity capable of containing the pouch pack 52. In a front end part of the container case 50, a gripping part 50*a* griped by a worker in replacing is provided.

As shown in FIGS. 8 and 9, the spout cover 51 is formed in a roughly rectangular parallelepiped shape shortened in the forward and backward directions. The spout cover 51 is configured so as to be divided into two upper and lower parts. In a front part of the spout cover 51, an engaging part 51*a* engaging with a rear end part of the container case 50 is formed. At the center of a front end face of the spout cover 51, a spout insertion hole 53 is bored and, at the center of a rear end face of the spout cover 51, a circular connection introducing hole 54 is bored. In a top face of the spout cover 51, a plurality of identification recessed parts 51*b* for identifying the color and others of the ink in the ink container 26 (the pouch pack 52) installed to the container installed part 8 are recessed. Incidentally, the container installed part 8 (the connecting frame 37) includes a detecting device (not shown) detecting the identification recessed parts 51*b* or protrusions (not shown) corresponding to shapes of the identification recessed parts 51*b*.

As shown in FIGS. 9 and 10, the pouch pack 52 as a liquid storage is formed in a bag shape elongated in the forward and backward directions and includes a pack main body 55 as a liquid storing part storing the ink and a spout 56 having a flow path 56*a* (refer to FIG. 6) opened and closed according to attaching and detaching of the connecting mechanism part 33 as a flow destination of the ink stored in the pack main body 55.

The pouch pack 52 is contained in the container case 50 in a state that the spout 56 is directed backwardly. The pouch pack 52 encloses the ink in the pack main body 55 in a vacuum state and flows out the ink from the spout 56.

As shown in FIG. 10, the pack main body 55 is formed in a bag shape by superimposing vertically two upper and lower film materials 55*a* in a rectangular shape elongated in the forward and backward directions from a plane view and by thermo-compressing (welding) their peripheries. The film material 55*a* has flexibility and is configured, for example, by laminating polyester, aluminum, nylon and low level density polyethylene in order from a surface side.

The spout 56 includes a supplying port 57 connected in a state exposed from the pack main body 55, a connecting port 58 formed integrally at a backward side of the supplying port 57 and sealed in a state put between a pair of the upper and lower film materials 55*a* and a sealing member 59 enclosing the ink stored in the pack main body 55.

As shown in FIGS. 6 and 7, the supplying port 57 is formed in a hollow cylindrical shape so as to communicate the inside and the outside the pack main body 55. The supplying port 57 also works as a filling port filling the ink in the pack main body 55 and is enclosed by the sealing member 59 after the pack main body 55 is filled with the ink.

In a circumference of a rear side of the supplying port 57, a pair of engaging flanges 57*a* in an octagonal shape extending to the outside in a radial direction are arranged in parallel in the forward and backward directions. By engaging an edge part of the spout insertion hole 53 of the above-mentioned spout cover 51 between the pair of front and rear engaging flanges 57*a*, the spout 56 is held by the spout insertion hole 53 (refer to FIG. 9). Incidentally, the shape of each engaging flange 57*a* may be optional, for example, a circular shape or a rectangular shape. In a further backward side of the engaging flange 57*a*, an annular protruding part 57*b* slightly protruding from a circumference face is formed (refer to FIG. 6).

As shown in FIGS. 6 and 7, the sealing member 59 includes a valve body unit 60 installed inside the supplying port 57 and a cap 61 attached so as to cover the supplying port 57 from rear ends (downstream ends in a flowing-out direction of the ink) of the supplying port 57 and the valve body unit 60.

The valve body unit 60 is configured so as to integrate a pedestal 62 arranged inside the supplying port 57, a coil spring 63 supported by the pedestal 62, a valve main body 64 biased backwardly by the coil spring 63 and a check valve 65 arranged between the pedestal 62 and the coil spring 63 and opened only when the ink is flowed out to the outside.

The pedestal 62 is formed in a hollow cylindrical shape with a smaller diameter than an internal diameter of the supplying port 57. In a front end face of the pedestal 62, a projected wall face part 62*a* and a recessed wall face part 62*b* recessed forwardly in its center by one step are formed. Inside the pedestal 62, a supporting shaft part 66 is arranged along the flowing-out direction (the forward and backward directions) of the ink. Near a base part of the supporting shaft part 66, four pedestal side supplying holes (not shown) for flowing out the ink stored in the pack main body 55 are opened.

The coil spring 63 has elasticity and is formed by resin material (e.g. polyester, polyetheretherketone, polyacetal or the like) or metal (e.g. stainless steel or the like) with excellent corrosion resistance.

The valve main body 64 has a valve body cylinder part 67 formed in a cylindrical shape with opening a front side, a valve body supporting part 68 formed integrally in the center of a rear end face of the valve body cylinder part 67 and an O-ring 69 supported by the valve body supporting part 68.

The valve body cylinder part 67 is formed to have an external diameter which can be inserted inside the pedestal 62. In a front end part of the valve body cylinder part 67, locking claws 67*a* inserting from the inside into valve body engaging holes 62*c* opened in the pedestal 62 are protruded outwardly in a radial direction. The valve body supporting part 68 is formed in a hollow cylindrical shape into which the supporting shaft part 66 can be inserted. A distal end part of the valve body supporting part 68 is formed in a tapered shape. The O-ring 69 is supported by fitting into a base part of the valve body supporting part 68.

The check valve 65 is formed by a roughly circular thin film-like material. In the check valve 65, a shaft inserted hole (not shown), into which the supporting shaft part 66 is inserted, is formed.

Next, an assembly procedure of the valve body unit 60 will be described.

First, the worker relatively inserts the supporting shaft part 66 into the shaft inserted hole of the check valve 65 and pushes the check valve 65 to a base part (a front end part) of the supporting shaft part 66. Thereby, the check valve 65 is located inside the recessed wall face part 62*b* of the pedestal 62 in a state that rotation around an axis is restricted. Subsequently, the worker inserts the supporting shaft part 66 into a shaft center of the coil spring 63. A front end of the coil spring 63 comes into contact with the projected wall face part 62*a* of the pedestal 62.

Next, the worker attaches the valve main body 64 by pushing it forwardly from a back side of the pedestal 62. In this state, a rear end face of the coil spring 63 comes into contact with an inside end face of the valve body cylinder part 67. Moreover, the locking claws 67*a* of the valve body cylinder part 67 is engaged with the valve body engaging holes 62*c*. Thereby, the pedestal 62, the coil spring 63, the valve main body 64 and the check valve 65 are constructed in one unit (refer to FIG. 6).

Incidentally, the valve main body 64 is supported movably in the forward and backward directions with respect to an inner circumference face of the pedestal 62 and the supporting shaft part 66. The check valve 65 is supported between the recessed wall face part 62*b* and the coil spring 63 movably in the forward and backward directions with respect to the base part of the supporting shaft part 66.

As shown in FIG. 6, the cap 61 has a roughly cylindrical exterior with opening a front side and has a cap main body 70 formed with a larger diameter than an external diameter of the supplying port 57 and a cylindrical valve seat tube part 71 arranged coaxially with the cap main body 70 to protrude forwardly from a rear end face of the cap main body 70.

Inside a front end of the cap main body 70, an annular hook part 70*a* locked by the above-mentioned annular protruding part 57*b* of the supplying port 57 is formed. A rear end face of the cap main body 70 composes a contact face 75 with which the connecting part 42 comes into contact when attaching the connecting mechanism part 33. The contact face 75 is formed in parallel to a vertical plane when attaching the connecting mechanism part 33 and is formed so as to cover the supplying port 57. Incidentally, as described in detail later, in the contact face 75, a liquid groove 76 is recessed. Moreover, in an outer circumference face of the cap main body 70, a first liquid absorbing member 77 is arranged.

The valve seat tube part 71 is formed with a smaller external diameter than an internal diameter of the pedestal 62 and the valve seat tube part 71 is formed with a larger internal diameter than an external diameter of the valve body supporting part 68. Inside the valve seat tube part 71, a through hole 72 is formed. An opening part 72*a* of the through hole 72 is formed at the center of the contact face 75 of the cap main body 70. Inside a front end of the valve seat tube part 71, a chamfered valve seat 73 is formed. In an inside face of a rear end between the cap main body 70 and the valve seat tube part 71, an annular cap sealing material 74 is arranged. Incidentally, the cap sealing material 74 may be omitted.

Next, attachment of the cap 61 to the supplying port 57 will be described.

First, the worker attaches the cap 61 from a rear side to the supplying port 57 into which the valve body unit 60 is inserted. Concretely, the worker inserts the supplying port 57 into the cap main body 70 relatively to engage the annular hook part 70*a* of the cap main body 70 with the annular protruding part 57*b* of the supplying port 57. At this time, a rear end face of the pedestal 62 becomes a state coming into pressure contact with the cap sealing material 74 and the O-ring 69 of the valve main body 64 becomes a state coming into pressure contact with the valve seat 73 of the cap 61. Incidentally, the valve main body 64 is pushed slightly forwardly against biasing force of the coil spring 63.

Accordingly, the attachment of the cap 61 to the supplying port 57 is completed. In this state, inside of the valve body unit 60, the flow path 56*a* is arranged between from the pedestal side supplying holes to the opening part 72*a* of the cap 61. Moreover, the O-ring 69 is pressured to the valve seat 73 by the biasing force of the coil spring 63 (a valve closing state) to prevent the ink stored in the pack main body 55 from leaking.

Next, with reference to FIGS. 6 and 7, a procedure installing the ink container 26 configured above to the container installed part 8 will be described. In detail, connecting action of the connecting main body 38 of the connecting mechanism part 33 and the spout 56 of the pouch pack 52 and flow of the ink will be described. Incidentally, as shown in FIG. 6, it is assumed that the valve body unit 60 becomes the valve closing state.

The worker inserts the ink container 26 backwardly from a front side of the container installed part 8. Then, the connecting main body 38 of the connecting mechanism part 33 enters the spout cover 51 from the connection introducing hole 54 (refer to FIG. 6) and the contact face 75 of the spout 56 comes into contact with the connecting part 42 of the connecting main body 38.

As pushing of the ink container 26 is advanced, the connecting part 42 is pushed backwardly and the needle 41 is relatively moved forwardly. The needle 41 projects forwardly from the circular hole 48 of the connecting part 42 and enters the through hole 72 from the opening part 72*a* opened in the contact face 75 of the spout 56 (refer to FIG. 7).

As pushing of the ink container 26 is further advanced, a front end face of the needle 41 comes into contact with a rear end face of the valve body supporting part 68 and the needle 41 is moved slightly backwardly against biasing force of the biasing member 45. The valve main body 64 is moved forwardly against the biasing force of the coil spring 63. Thereby, the O-ring 69 coming into pressure contact with the valve seat 73 of the cap 61 is separated forwardly to become a valve opening state (refer to FIG. 7). Accordingly, connection of the connecting main body 38 and the spout 56 is completed.

When becoming the valve opening state, the ink stored in the pack main body 55 is pushed out to the spout 56 by atmospheric pressure generally acted to the pack main body 55. By this flowing-out pressure of the ink, the check valve 65 is moved backwardly and each pedestal side supplying hole is opened.

As indicated by a broken line arrow in FIG. 7, the ink flowed out from the pack main body 55 to the supplying port 57 flows into the flow path 56*a* arranged inside the valve body unit 60, passes through a gap between the valve seat 73 and the O-ring 69 and each flow opening part 46 of the needle 41, and flows into the inside of the needle 41. In addition, the ink flows to the sub container 26*a* via the ink supplying tube 26*b* connected to the tube connected part 43 of the guide tube part 40. As mentioned above, the pack main body 55 and the recording head 25 are communicated via the spout 56 and the needle 41 and the ink in the pack main body 55 is supplied to the recording head 25.

Incidentally, for some reason, when the valve main body 64 is opened, the check valve 65 is moved forwardly by pressure of the backward-flowing ink and each pedestal side supplying hole is closed. Thereby, it is possible to prevent inflow of air from the outside and to prevent dissolution of air with respect to the ink in the pack main body 55.

Incidentally, in a case where the ink is consumed and residual quantity is reduced (or emptied), replacement of the ink container 26 is carried out. Replacing work of the ink container 26 is completed by attaching new ink container 26 in the above-mentioned installing procedure after old ink container 26 is detached in a reverse procedure to the above-mentioned installing procedure. Because the needle 41 of each connecting mechanism part 33 is inserted to/extracted from the opening part 72*a* leading to the flow path 56*a*, when the needle 41 is relatively pulled out from the opening part 72*a* (the through hole 72), the ink leaked slightly from the opening part 72*a* may be adhered onto the contact face 75 of the cap 61.

Thereupon, in the spout 56 of the pouch pack 52 according to the first embodiment, as described above, the liquid groove 76 and the first liquid absorbing member 77 are arranged.

As shown in FIG. 10, the liquid groove 76 is recessed in the contact face 75 so as to guide and hold the ink adhered onto the opening part 72*a* when being detached from each connecting mechanism part 33 (the needle 41). In detail, the liquid groove 76 has a plurality of first liquid grooves 78 formed in a linear shape directing the outside in a radiating direction from the opening part 72*a* and a plurality of second liquid grooves 79 having similar shapes coaxially with the opening part 72*a* at the outside in the radiating direction of the opening part 72*a*.

For example, four first liquid grooves 78 are formed in regular intervals (90 degree intervals) in a circumference direction of the contact face 75. Four first liquid grooves respectively have center side end parts opened to the opening part 72*a*. Four first liquid grooves 78 are respectively extended from upper, lower, left and right sides of the opening part 72*a* to the outside in the radiating direction (the radial direction) and have outer end parts opened to the outer circumference face of the cap main body 70. That is, each first liquid groove 78 communicates the opening part 72*a* and the outer circumference face of the cap main body 70.

For example, two second liquid grooves 79 are formed so as to become concentric with the opening part 72*a*. Each first liquid groove 78 mentioned above is formed so as to intersect two second liquid grooves. That is, two second liquid grooves 79, the opening part 72*a* and the outer circumference face of the cap main body 70 are communicated by each first liquid groove 78.

Each first liquid groove 78 and each second liquid groove 79 are recessed so as to have rectangular and roughly U-shape section. Each first liquid groove 78 and each second liquid groove 79 have widths and depths so that capillary phenomenon can be produced. Each liquid groove 78, 79 has width and depth so that the ink guided by the capillary phenomenon can be held by surface tension. The width and the depth of each liquid groove 78, 79 are determined suitably according to viscosity of the ink, temperature and others, for example, preferably determined optionally within a range from 0.5 mm to 3.0 mm.

The first liquid absorbing member 77 is pasted, for example, by adhesive, double sided tape or the like so as to cover the outer circumference face of the spout 56. The first liquid absorbing member 77 is arranged adjacent to an outer end part in the radiating direction of each first liquid groove 78 and configured so as to absorb the ink guided to each liquid groove 78, 79. The first liquid absorbing member 77 is preferably made of porous material with high average porosity. As the first liquid absorbing member 77, sponge made of polyurethane or non-woven made of polyester or polyurethane can be used.

In accordance with the pouch pack 52 according to the above-described first embodiment, for example, when each connecting mechanism part 33 is relatively detached from the contact face 75, the ink leaked slightly from the opening part 72*a* is penetrated into each first liquid groove 78 by the capillary phenomenon and guided to each first liquid groove 78 and each second liquid groove 79. Then, by the surface tension of the ink itself, it intends to stay inside each first liquid groove 78 and each second liquid groove 79. Thereby, it is possible to prevent the leaked ink from dripping to the inside of the spout cover 51 and container installed part 8. According to this, it is possible to prevent soiling due to a dripped ink.

Moreover, in accordance with the pouch pack 52 according to the first embodiment, the leaked ink is penetrated directly from the opening part 72*a* to each first liquid groove 78. Thereby, each first liquid groove 78 can smoothly guide the ink. Further, since, in addition to the plurality of first liquid grooves 78, the plurality of second liquid grooves 79 are formed, it is possible to increase capacity holding the ink. Thereby, it is possible to restrain the ink held by the liquid groove 76 (78, 79) from overflowing and dripping.

Moreover, in accordance with the pouch pack 52 according to the first embodiment, the ink guided by the liquid groove 76 (each first liquid groove 78) is absorbed by the first liquid absorbing member 77. Thereby, it is possible to effectively restrain the ink from overflowing and dripping from each liquid grooves 78, 79. In addition, each liquid grooves 78, 79 can maintain guiding function and holding function of the ink over a long period.

Moreover, in accordance with the pouch pack 52 according to the first embodiment, the liquid groove 76 and the first liquid absorbing member 77 are arranged in the cap 61. Therefore, for example, by attaching the cap 61 to the supplying port 57 connected to an existing liquid storing part (a pack main body), it is possible to compose the pouch pack 52 capable of restraining dripping the leaked ink easily and inexpensively.

Incidentally, the numbers of the first liquid grooves 78 and the second liquid grooves 79 to be formed are optional, and each may be formed at least one.

In the pouch pack 52 according to the above-described first embodiment, since the contact face 75 of the spout 56 is formed vertically, for example, the leaked ink intends to move downwardly by gravity. Therefore, it is preferable that at least one first liquid groove 78 is formed in a linear shape directing downwardly from the opening part 72*a*. In accordance with this configuration, the first liquid groove 78 directing downwardly can further smoothly guide the ink.

Second Embodiment

Figure 11:
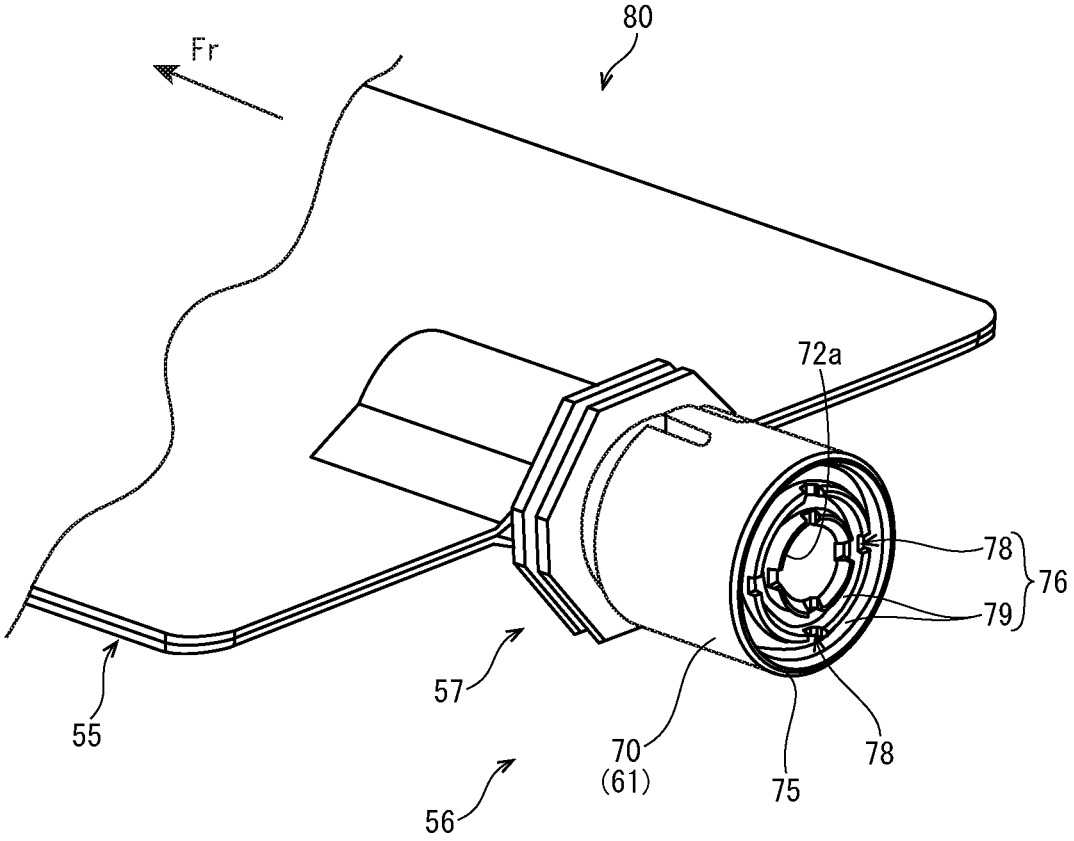
FIG. 11 It is a perspective view showing a part of a pouch pack in accordance with a second embodiment of the present invention.

Next, with reference to FIG. 11, a pouch pack 80 according to a second embodiment will be described. Here, FIG. 11 is a perspective view showing a part of the pouch pack 80. Incidentally, in the description of other embodiments mentioned later, with respect to similar configuration to the pouch pack 52 according to the above-described first embodiment, describing will be omitted and the same reference numerals will be applied.

Although, in the pouch pack 52 according to the above-described first embodiment, the first liquid absorbing member 77 is arranged on the outer circumference face of the cap main body 70, in the pouch pack 80 according to the second embodiment, there is a difference in omitting the first liquid absorbing member 77. In this case, the outer end part of the first liquid groove 78 is closed by an outer circumference wall of the cap main body 70.

In accordance with the pouch pack 80 according to the second embodiment, for example, when detaching each connecting mechanism part 33, the ink leaked slightly from the opening par 72*a* is guided by each first liquid groove 78 and each second liquid groove 79 and intends to stay inside each liquid groove 78, 79 by surface tension of itself. Thereby, it is possible to restrain dripping of the leaked ink and to prevent soiling due to a dripped ink.

Third Embodiment

Figure 12:
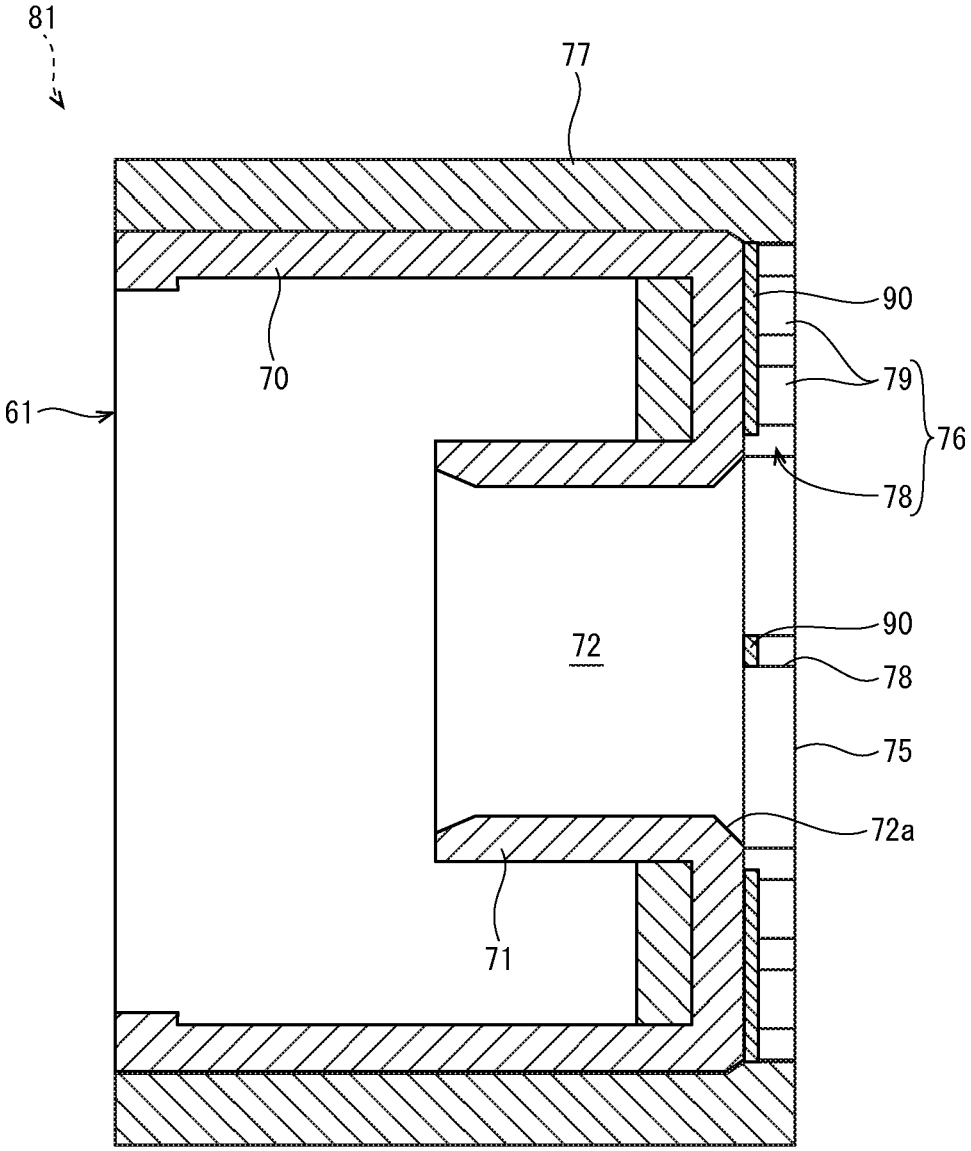
FIG. 12 It is a sectional view schematically showing a cap of a spout of a pouch pack in accordance with a third embodiment of the present invention.

Next, with reference to FIG. 12, a pouch pack 81 according to a third embodiment will be described. FIG. 12 is a sectional view schematically showing the cap 61 of the spout 56 of the pouch pack 81.

In the pouch pack 81 according to the third embodiment, there is a difference in arranging a second liquid absorbing member 90 absorbing the ink at a bottom part of the liquid groove 76 in addition to first liquid absorbing member 77. The second liquid absorbing member 90 is laid at a bottom part of each first liquid groove 78 and a bottom part of each second liquid groove 79 except for a part adjacent to the opening part 72*a*. Incidentally, material composing the second liquid absorbing member 90 is similar to the first liquid absorbing member 77.

In accordance with the pouch pack 81 according to the third embodiment, the ink guided to the liquid groove 76 is absorbed by the second liquid absorbing member 90 (and the first liquid absorbing member 77). According to this, it is possible to effectively restrain dripping of the ink guided to the liquid groove 76.

Incidentally, in a case of making the ink effectively absorbed by the second liquid absorbing member 90, it is preferably that the second liquid absorbing member 90 comes into contact with the needle 41. However, in this case, there is a possibility of occurring harmful effects that the second liquid absorbing member 90 is bitten by a contact part of the needle 41 and the opening part 72*a* and a broken fragment of the second liquid absorbing member 90 is fallen down and penetrated in the flow path 56*a*. In this point, in accordance with the pouch pack 81 according to the third embodiment, since the second liquid absorbing member 90 is not adjacent to the opening part 72*a*, when inserting/extracting the needle 41 with respect to the opening part 72*a*, the needle 41 never comes into contact with the second liquid absorbing member 90. Thereby, it is possible to prevent break (damage) of the second liquid absorbing member 90 and prevent harmful effects, such as falling-down of a broken fragment of the second liquid absorbing member 90 and penetrating of such a broken fragment in the flow path 56*a*.

Incidentally, although, in the pouch pack 81 according to the third embodiment, the second liquid absorbing member 90 is further arranged in addition to the first liquid absorbing member 77, the invention is not restricted by this. For example, the first liquid absorbing member 77 may be omitted and only the second liquid absorbing member 90 may be arranged. Alternatively, the second liquid absorbing member 90 may be arranged to the pouch pack 80 according to the second embodiment.

Fourth Embodiment

Figure 13:
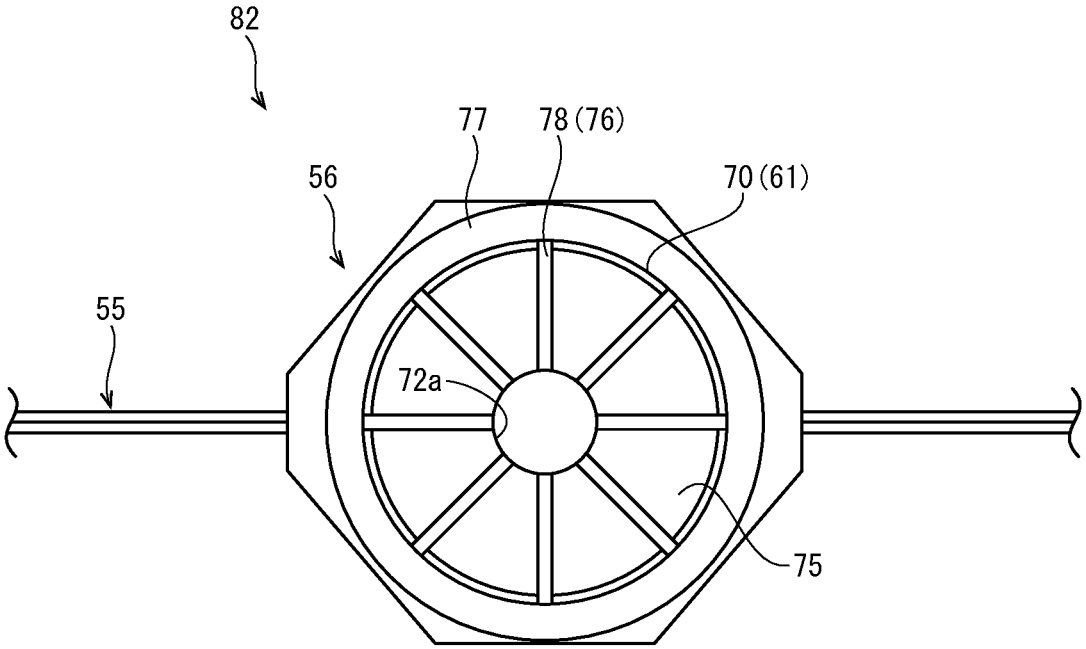
FIG. 13 It is a back view schematically showing a spout of a pouch pack in accordance with a fourth embodiment of the present invention.

Next, with reference to FIG. 13, a pouch pack 82 according to a fourth embodiment will be described. FIG. 13 is a back view schematically showing the spout 56 of the pouch pack 82.

Although, in the pouch pack 52 according to the above-described first embodiment, the liquid groove 76 is composed of the plurality of first liquid grooves 78 and the plurality of second liquid grooves 79, in the pouch pack 82 according to the fourth embodiment, there is a difference in omitting the plurality of second liquid grooves 79 and having only the plurality of first liquid grooves 78. For example, eight first liquid grooves 78 are formed in regular intervals (45 degree intervals) in the circumference direction of the contact face 75.

Incidentally, the numbers of the first liquid grooves 78 to be formed are optional, and at least one may be formed. Preferably, it is sufficient that at least one first liquid groove 78 is formed in a linear shape directing downwardly from the opening part 72*a*.

Fifth Embodiment

Figure 14:
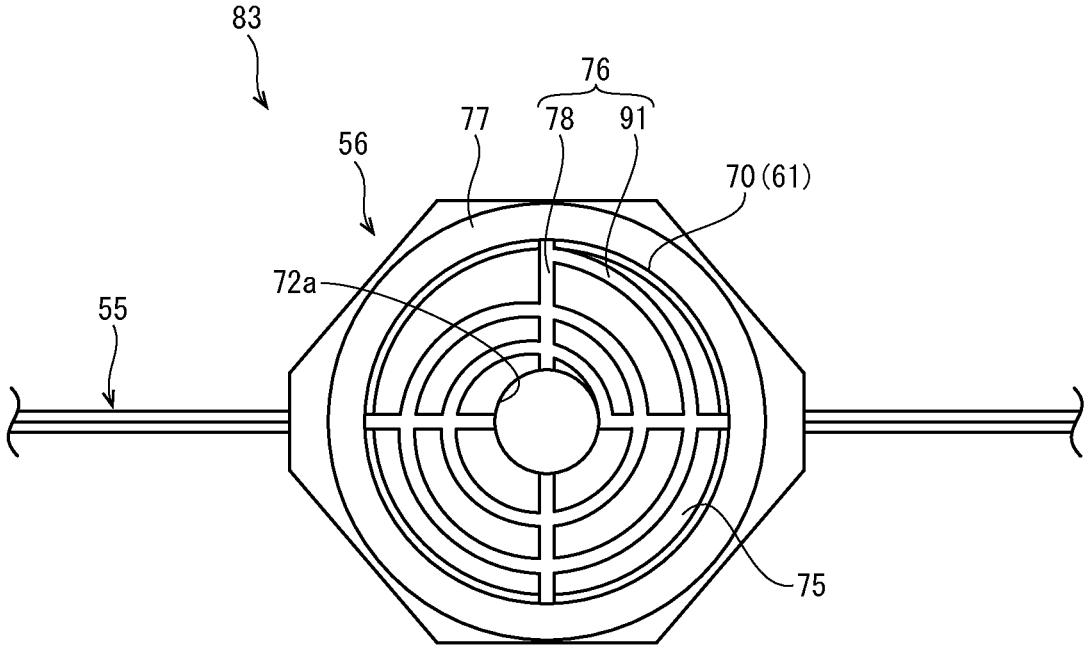
FIG. 14 It is a back view schematically showing a spout of a pouch pack in accordance with a fifth embodiment of the present invention.

Next, with reference to FIG. 14, a pouch pack 83 according to a fifth embodiment will be described. FIG. 14 is a back view schematically showing the spout 56 of the pouch pack 83.

Although, in the pouch pack 52 according to the above-described first embodiment, the plurality of second liquid grooves 79 is configured in a coaxial shape, in the pouch pack 83 according to the fifth embodiment, there is a difference in forming a second liquid groove 91 in a spiral shape toward the outside in the radiating direction from the opening part 72*a*.

In accordance with the pouch pack 83 according to the fifth embodiment, it is possible to achieve the similar effect to the pouch pack 52 according to the first embodiment.

Incidentally, in the pouch pack 82 according to the fourth embodiment and in the pouch pack 83 according to the fifth embodiment, the first liquid absorbing member 77 or/and the second liquid absorbing member 90 may be arranged.

Incidentally, although, in the pouch pack 52, 80, 81, 82, 83 according to each embodiment described above, the contact face 75 (the liquid groove 76 and others) is formed in the cap 61, the invention is not restricted by this. For example, the cap 61 may be omitted and the contact face 75 (the liquid groove 76 and others) may be formed in the supplying port 57. Moreover, the shapes of the first liquid groove 78 and the second liquid groove 79, 91 are optional.

While the preferable embodiment and its modified example of the liquid storage and the inkjet image forming apparatus including this of the present invention have been described above and various technically preferable configurations have been illustrated, a technical range of the invention is not to be restricted by the description and illustration of the embodiment. Further, the components in the embodiment of the invention may be suitably replaced with other components, or variously combined with the other components. The claims are not restricted by the description of the embodiment of the invention as mentioned above.

The invention claimed is:

1. A liquid storage comprising:

a liquid storing part storing liquid; and a spout having a flow path opened/closed according to relative attaching and detaching of a connected subject being a flow destination of the liquid stored in the liquid storing part, wherein the spout including:

a contact face having an opening part opened so as to lead to the flow path, with which the connected subject comes into contact when attaching the connected subject; and a liquid groove recessed in the contact face to guide and hold the liquid adhered onto the opening part when detaching the connected subject, wherein the liquid groove has at least one first liquid groove formed in a linear shape directing the outside in a radiating direction from the opening part.

2. The liquid storage according to claim 1, wherein the liquid groove has width and depth respectively determined from 0.5 mm to 3.0 mm.

3. The liquid storage according to claim 1, wherein the contact face of the spout is formed in parallel to a vertical plane when attaching the connected subject, at least one first liquid groove is formed in a linear shape directing downwardly from the opening part.

4. The liquid storage according to claim 1, wherein a plurality of the first liquid grooves are formed in regular intervals in a circumferential direction of the contact face.

5. The liquid storage according to claim 1, wherein the liquid groove further has at least one second liquid groove having the similar shape coaxially with the opening part at the outside in a radiating direction of the opening part.

6. The liquid storage according to claim 1, wherein the liquid groove further has a second liquid groove formed in a spiral shape toward the outside in a radiating direction from the opening part.

7. The liquid storage according to claim 1, wherein the spout further includes:

a supplying port connected to the liquid storing part;

a valve body unit arranged inside the supplying port; and a cap arranged so as to cover the supplying port, in which the contact face is formed.

8. An ink container comprising:

the liquid storage according to claim 2.

9. An inkjet image forming apparatus comprising:

the ink container according to claim 8.

10. A liquid storage comprising:

a liquid storing part storing liquid; and a spout having a flow path opened/closed according to relative attaching and detaching of a connected subject being a flow destination of the liquid stored in the liquid storing part, wherein the spout including:

a contact face having an opening part opened so as to lead to the flow path, with which the connected subject comes into contact when attaching the connected subject; and a liquid groove recessed in the contact face to guide and hold the liquid adhered onto the opening part when detaching the connected subject, wherein the spout further includes a first liquid absorbing member arranged adjacent to an outer end part in a radiating direction of the liquid groove and configured so as to absorb the liquid guided to the liquid groove.

11. A liquid storage comprising:

a liquid storing part storing liquid; and a spout having a flow path opened/closed according to relative attaching and detaching of a connected subject being a flow destination of the liquid stored in the liquid storing part, wherein the spout including:

a contact face having an opening part opened so as to lead to the flow path, with which the connected subject comes into contact when attaching the connected subject; and a liquid groove recessed in the contact face to guide and hold the liquid adhered onto the opening part when detaching the connected subject, wherein the connected subject has a needle inserted to/extracted from the opening part, the spout further includes a second liquid absorbing member absorbing the liquid at a bottom part of the liquid groove except for a part adjacent to the opening part.

* * * * *